US010196821B2

(12) United States Patent
Anderson et al.

(10) Patent No.: US 10,196,821 B2
(45) Date of Patent: Feb. 5, 2019

(54) ROOFING PANELS

(71) Applicant: Building Materials Investment Corporation, Dallas, TX (US)

(72) Inventors: Eric R. Anderson, Montclair, NJ (US); Tommy Rodrigues, Nutley, NJ (US); Sudhir Railkar, Wayne, NJ (US)

(73) Assignee: Building Materials Investment Corporation, Dallas, TX (US)

( * ) Notice: Subject to any disclaimer, the term of this patent is extended or adjusted under 35 U.S.C. 154(b) by 0 days.

(21) Appl. No.: 15/015,288

(22) Filed: Feb. 4, 2016

(65) Prior Publication Data

US 2016/0222667 A1 Aug. 4, 2016

Related U.S. Application Data

(60) Provisional application No. 62/112,016, filed on Feb. 4, 2015.

(51) Int. Cl.
*E04D 1/30* (2006.01)
*E04D 1/26* (2006.01)
(Continued)

(52) U.S. Cl.
CPC ..... *E04D 1/30* (2013.01); *B44C 1/24* (2013.01); *B44C 5/04* (2013.01); *E04D 1/265* (2013.01); *E04D 3/365* (2013.01); *E04D 3/24* (2013.01)

(58) Field of Classification Search
CPC .... E04D 1/30; E04D 1/18; E04D 1/28; E04D 13/0445; E04D 1/34; B44F 9/02; B44F 9/04
(Continued)

(56) References Cited

U.S. PATENT DOCUMENTS 393,516 A * 11/1888 Packer ..... E04F 13/0864 52/519
550,325 A 11/1895 Kinnear
(Continued)

FOREIGN PATENT DOCUMENTS

CA 2332671 A1 7/2002
EP 350587 A1 * 1/1990 ..... E04D 1/18
(Continued)

OTHER PUBLICATIONS

Two photographs of metal shingles.
Figure 2-43. Modular Metal Shingles Installed Direct-to-Deck.

*Primary Examiner* — Babajide A Demuren
(74) *Attorney, Agent, or Firm* — Womble Bond Dickinson (US) LLP

(57) ABSTRACT

A roofing panel has a field, an upper edge, a lower edge, a first end, and a second end. The field of the roofing panel is ornamented such as by being coated and/or embossed and/or pressed to emulate the appearance of a traditional roofing shingle. A clip extends along the forward edge of the roofing panel and projects downwardly therefrom. A slot extends along the rear edge of the roofing panel and the slot has an upwardly facing elongated opening. The slot is cut short or truncated at the first end of the roofing panel such that the second end of a like shingle can be overlapped onto the first end in such a way that the ornamentation on the field of the roofing panel prevents water migration through the region of overlap of the roofing panel and the like roofing panel. The clip is configured to be pressed down by an installer through the opening of the slot and lock within the slot to attach one course of shingles securely to a next lower course of shingles.

23 Claims, 6 Drawing Sheets

(51) Int. Cl.

| | |
|---|---|
| ***E04D 3/365*** | (2006.01) |
| ***B44C 1/24*** | (2006.01) |
| ***B44C 5/04*** | (2006.01) |
| *E04D 3/24* | (2006.01) |

(58) Field of Classification Search
USPC ..... 52/518, 519, 556, 555, 554
See application file for complete search history.

(56) References Cited

U.S. PATENT DOCUMENTS 622,417 A * 4/1899 Cohen ..... E04D 1/265 52/556
D51,438 S 10/1917 Caron
1,473,275 A * 11/1923 Burgett ..... E04D 1/06 52/536
1,743,206 A * 1/1930 Fulenwider ..... E04D 1/06 52/520
1,811,385 A 6/1931 Dietz
D93,731 S 5/1935 Cahill
2,005,219 A * 6/1935 Burriss ..... E04D 3/362 52/519
2,042,890 A * 6/1936 Fulenwider ..... E04D 3/362 52/529
D105,276 S 7/1937 Hauck
2,685,852 A * 8/1954 Godel ..... E04D 1/06 52/16
D203,566 S 1/1966 Hayes
D209,719 S 12/1967 Ellis, Sr.
3,583,117 A 6/1971 Roach
3,608,261 A * 9/1971 French ..... B28B 1/526 264/241
3,643,392 A 2/1972 Martinez
3,968,610 A 7/1976 Medow
3,977,141 A * 8/1976 Peters ..... B44F 9/02 52/313
4,010,590 A * 3/1977 Reinke ..... E04D 1/06 52/533
4,079,561 A 3/1978 Vallee
D253,724 S 12/1979 Yanoh
D256,953 S 9/1980 Morita
D256,954 S 9/1980 Morita
D263,256 S 3/1982 Morse
4,343,126 A 8/1982 Hoofe, III
D275,325 S 8/1984 Gustavsson
4,588,443 A 5/1986 Bache
4,890,432 A * 1/1990 Shepherd ..... E04D 1/04 52/314
4,932,184 A * 6/1990 Waller ..... E04D 1/265 52/535
5,349,801 A * 9/1994 Verbofsky ..... E04D 3/30 52/478
5,423,153 A * 6/1995 Woolems ..... E04F 13/0864 52/233
5,469,680 A * 11/1995 Hunt ..... E04D 1/18 52/520
5,519,974 A * 5/1996 Greenberg ..... E04D 3/363 52/518
D372,545 S 8/1996 Schultz
5,598,677 A 2/1997 Rehm, III
5,613,337 A 3/1997 Plath et al.
5,651,227 A * 7/1997 Anderson ..... E04F 13/0864 52/519
D394,719 S 5/1998 Costantini
5,752,355 A * 5/1998 Sahramaa ..... E04D 3/30 52/519
D398,709 S 9/1998 Ross
5,813,183 A * 9/1998 Attley ..... B05C 19/04 52/177
D402,064 S 12/1998 Hahn
5,878,542 A * 3/1999 Cornelius ..... E04F 13/0864 52/233
5,878,543 A * 3/1999 Mowery ..... E04F 13/0864 52/519
D414,568 S 9/1999 Hedges
D415,848 S 10/1999 Plath
6,224,701 B1 * 5/2001 Bryant ..... E04F 13/0864 156/227
D462,129 S 8/2002 Sadosky, Jr.
D499,897 S 12/2004 Ricci
6,857,239 B2 2/2005 Sadosky, Jr.
D507,837 S 7/2005 King
D526,727 S 8/2006 Ross
D527,835 S 9/2006 Ross
7,246,474 B2 7/2007 Dombek et al.
D570,502 S 6/2008 Silverstrin
D586,008 S 2/2009 Vandewater, Jr.
D587,821 S 3/2009 Larsen
D607,585 S 1/2010 Larson
D608,916 S 1/2010 Simmons
D629,532 S 12/2010 Cornett
D643,133 S 8/2011 Steffes
D708,764 S 7/2014 Lin
D714,968 S 10/2014 Martin
D727,540 S 4/2015 Martin
D729,417 S 5/2015 Martin
9,097,019 B1 8/2015 Rasmussen
D738,541 S 9/2015 Tarvaran
D807,837 S 1/2018 Kayanuma et al.
2002/0160151 A1 * 10/2002 Pinault ..... B05D 5/02 428/144
2003/0131551 A1 * 7/2003 Mollinger ..... B29C 47/0019 52/518
2003/0192281 A1 * 10/2003 Bullinger ..... E04F 13/0864 52/539
2007/0107356 A1 5/2007 Steffes
2010/0186334 A1 7/2010 Seem
2011/0214375 A1 * 9/2011 Gaudreau ..... B29C 45/03 52/311.1

FOREIGN PATENT DOCUMENTS

GB 2202245 A * 9/1988 ..... E04D 1/20
GB 002202245 A2 * 9/1988
GB 2245613 A * 1/1992 ..... E04D 3/32
GB 2245617 A * 1/1992 ..... E04D 1/265

* cited by examiner

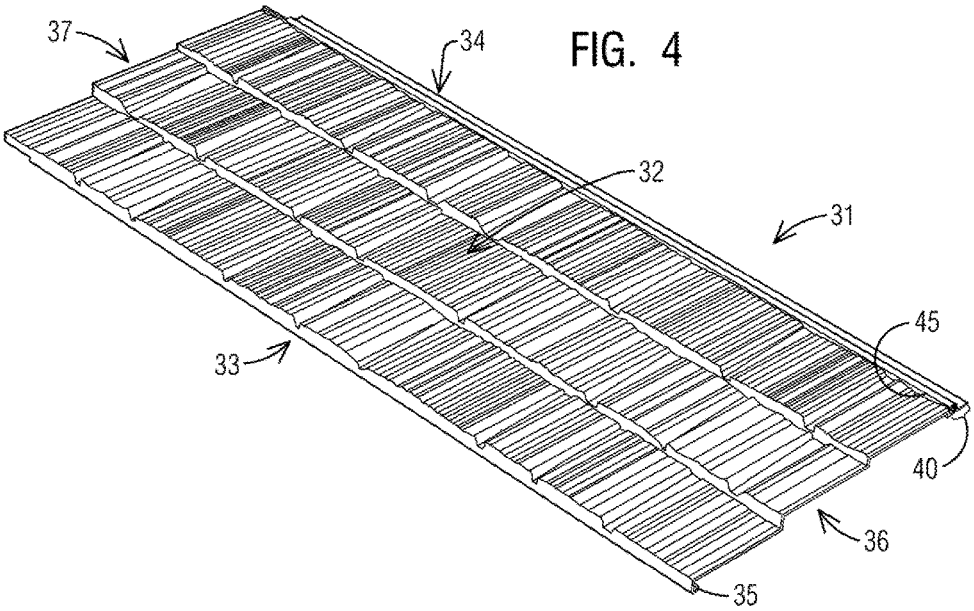
FIG. 4
FIG. 5
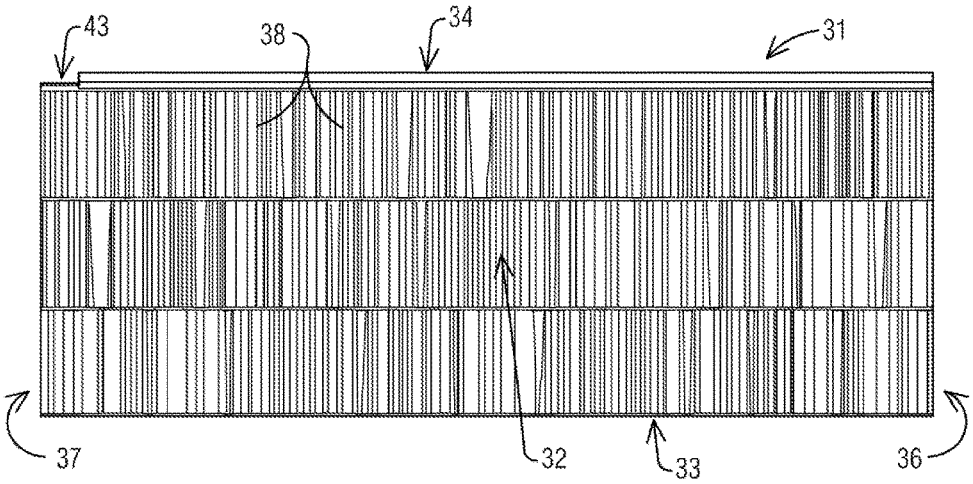
FIG. 6
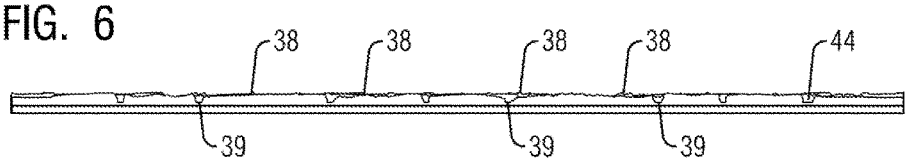

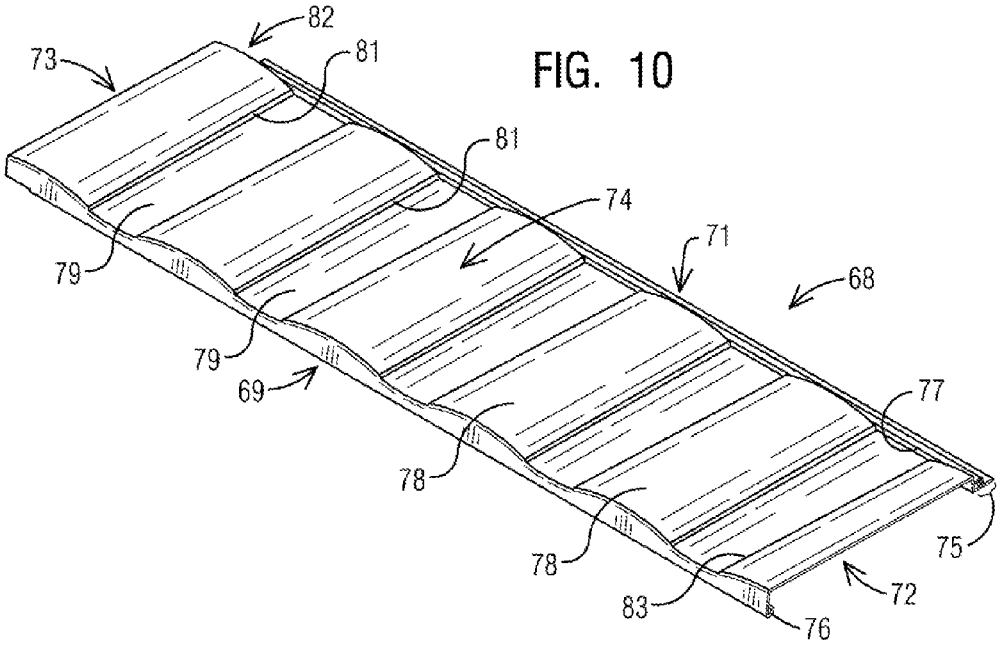
FIG. 10
FIG. 11
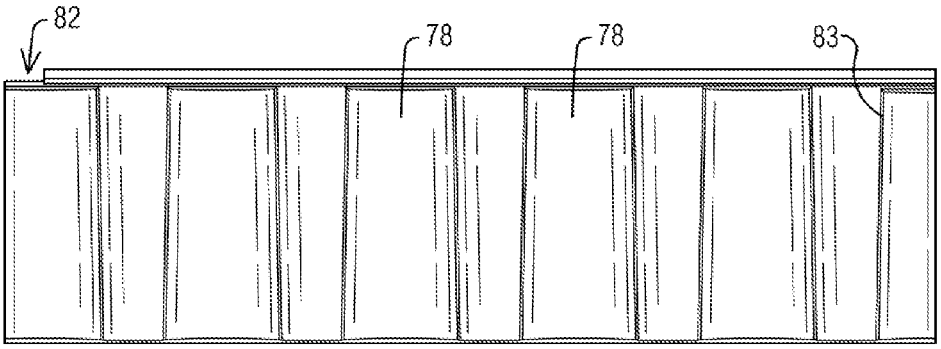
FIG. 12
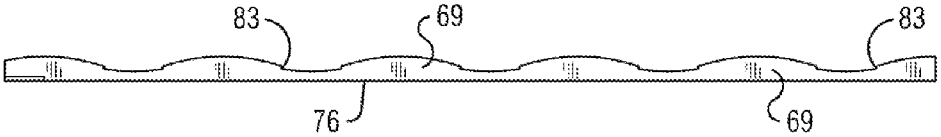

ROOFING PANELS

REFERENCE TO RELATED APPLICATION

Priority is hereby claimed to the benefit of the filing date of U.S. provisional patent application No. 62/112,016 filed on Feb. 4, 2015, the entire contents of which is hereby incorporated by reference.

TECHNICAL FIELD

This disclosure relates generally to roofing and more particularly to metal roofing panels that emulate the appearance of traditional roofing materials such as slate, cedar shake, asphalt, and clay barrel roofing.

BACKGROUND

Metal roofing has seen a resurgence in recent years because, among other things, of its durability, resistance to embers, and long life expectancy. Traditional metal roofing such as standing seam roofing in which long panels are attached to a roof extending from the ridge to the eave has been used for many years. In addition to this traditional metal roofing, metal roofing panels that are coated and embossed to resemble more traditional roofing materials such as slate or barrel roofing are in vogue. In the past, such roofing panels have not convincingly mimicked the look of the traditional roofing material they are meant to emulate and some can be downright cheesy looking to an observer. In addition, prior art metal roofing panels have often exhibited shortcomings in their resistance to leakage, particularly in a blowing rain or snow storm. Finally, some prior art metal roofing panels are attached with exposed nails or other fasteners, which can rust or otherwise deteriorate over time. A need exists for metal roofing panels that offer better aesthetic emulation of traditional roofing materials, better resistance to leakage in storms, and that are attached with hidden fasteners that are not exposed to the elements. It is to the provision of metal roofing panels that meet these and other needs that the present invention is primarily directed.

SUMMARY

Briefly described, a roofing panel, which preferably but not necessarily is made of metal sheet, is printed or coated with graphics and embossed or pressed to emulate better the appearance of traditional roofing materials when installed in courses on a roof. One embodiment emulates the appearance of traditional architectural asphalt shingles. Another emulates the appearance of a cedar shake shingled roof while yet another embodiment emulates the appearance of a slate roof. Another disclosed embodiment emulates better the appearance of clay barrel shingles and a roof covered with clay barrel shingles. The panels of this embodiment can be installed in unique patterns not possible with traditional clay barrel shingles. When installed on a roof, the panels overlap in a shiplap fashion at their ends in such a way that the aesthetic features of the panels form a water dam preventing migration of water through the end connections of the panels. A clipping interlock system along the forward and rear edges of the panels makes installation simple, secure, virtually fool proof, and virtually leak proof.

These and other aspects, features, and advantages of the invention disclosed herein through exemplary embodiments will become more apparent to one of skill in the art upon review of the detailed description set forth below taken in conjunction with the accompanying drawing figures, which are briefly described as follows.

BRIEF DESCRIPTION OF THE DRAWINGS

FIG. 4 is a top perspective view of a roofing panel that embodies principles of the invention in another preferred form.

FIG. 5 is a top plan view of the roofing panel of FIG. 4

FIG. 6 is a lower edge view of the roofing panel of FIG. 4

FIG. 10 is a top perspective view of a roofing panel that embodies principles of the invention in yet another preferred form.

FIG. 11 is a top plan view of the roofing panel of FIG. 10.

FIG. 12 is a lower edge view of the roofing panel of FIG. 10.

DETAILED DESCRIPTION

Figure 1:
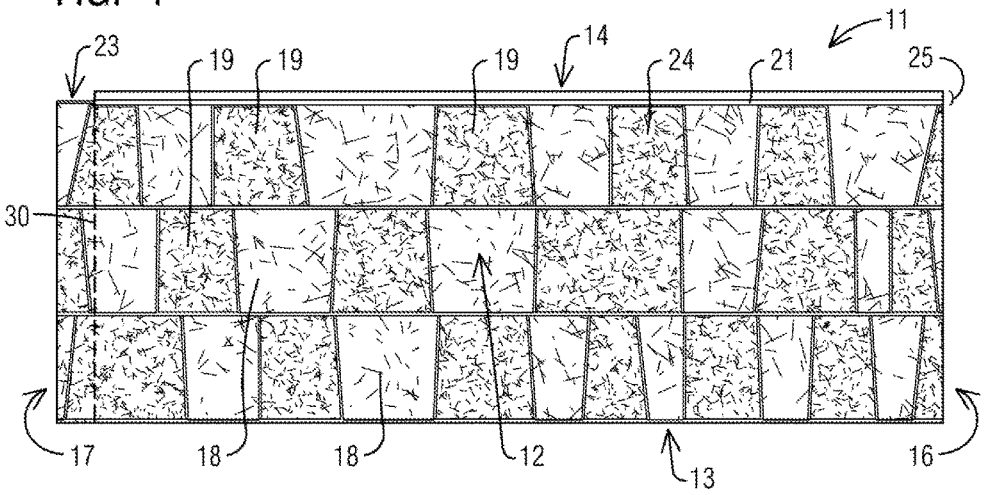
FIG. 1 is a top plan view of a roofing panel that embodies principles of the invention in one preferred form.

Reference will now be had in more detail to the annexed drawing figures, wherein like reference numerals, where appropriate, indicate like parts throughout the several views. The panels in the figures will be described for simplicity as being made of metal sheets. It will be understood, however, that this is not a limitation of the invention and the panels can be made of any other appropriate material such as a polymeric material, TCP, PVC, or any other sufficiently malleable and weather resistant material, all of which are intended to be included within the scope of the invention.

Figure 2:
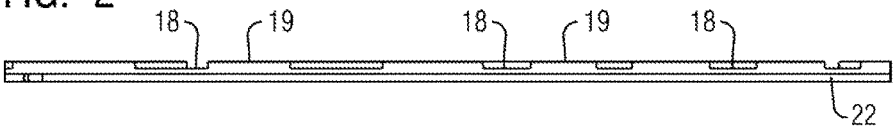
FIG. 2 is a lower edge view of the roofing panel of FIG. 1
Figure 3:
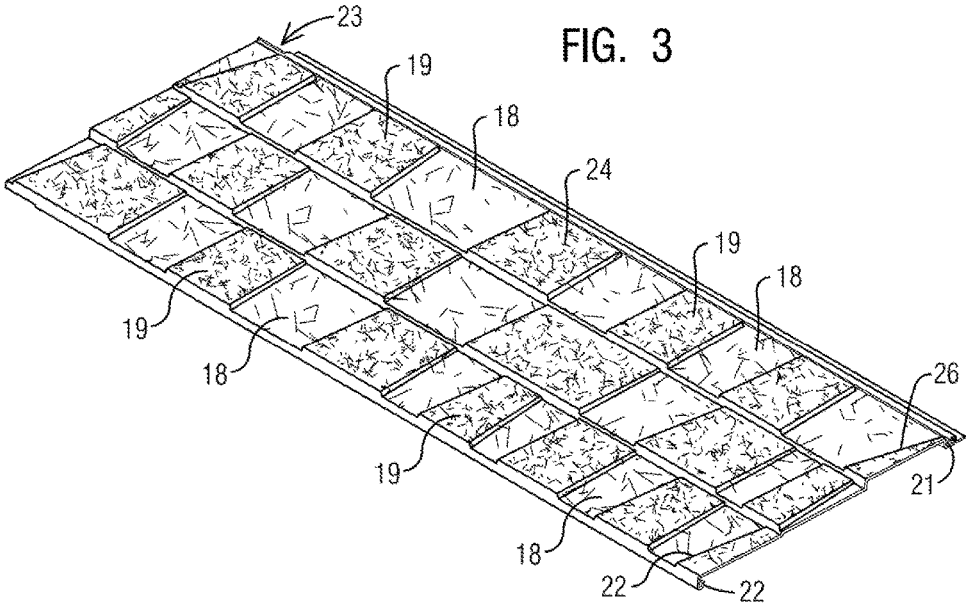
FIG. 3 is a top perspective view of the roofing panel of FIG. 1

FIGS. 1-3 show the roofing panel of this invention embodying an ornamental aesthetic that emulates the appearance of traditional architectural asphaltic shingles when installed on a roof. The panel 11 is generally rectangular in shape and includes an aesthetic field 12, a leading edge 13, a trailing edge 14, a first end 16, and a second end 17. A downwardly projecting clip 22 (FIG. 3) extends along the leading edge 13 of the panel and a narrow headlap portion 25 extends at least partially along the trailing edge 14 of the panel.

The headlap portion 25 is characterized by an elongated slot 21 that is configured to receive and interlock with the leading edge clip 22 of a like panel in a next higher course of panels. The details of this interlocking clipping system will be described in more detail below. The headlap portion is notched or truncated at one end as indicated by reference numeral 23 in FIGS. 1-3. This notched-out region is sized to accommodate the overlapping of the second end 17 of one panel with the first end 16 of adjacent panels arranged end-to-end during installation of the panels in a course of panels. Thus, panels of this embodiment are installed on a roof deck in overlapping end-to-end relationship to form courses of panels and in leading-to-trailing edge interlocked relationship to form adjacent courses of panels.

In the embodiment of FIGS. 1-3, the aesthetic field 12 of each panel is painted, printed, coated, or otherwise provided with graphics that emulate the appearance of clay granules on traditional asphaltic shingles. Alternatively, the aesthetic field may be covered with actual granules secured to the surface of the panel with an appropriate adhesive. The graphics may be applied to a sheet of metal before or after the sheet is stamped or otherwise formed into roofing panels and when it is contained on a large bulk roll of metal sheet to be paid out and formed into panels. The aesthetic field 12 of the panel 11 further is embossed, pressed, or otherwise formed with raised and lowered patterns that emulate the texture of a traditional architectural asphaltic shingle. More specifically the formed pattern emulates shingles having a lower base layer 18, 24 underlying an upper layer formed to define raised tabs known as dragon teeth 19. On the first end 16 of the panel, the edges of the formed aesthetic features, here the dragon teeth, define raised water barriers indicated at 26 in FIG. 3 that impede the migration of water through overlapping ends of adjoining panels.

When two panels are installed end-to-end with the second end 17 of one panel overlapping the first end 16 of the adjacent panel, the water barriers 26 formed by the aesthetic features on the first end prevent rainwater and snow from blowing underneath the overlap to the butt joint, from where it can leak onto the roof deck below. Further, forming the water barriers 26 as part of the pressed aesthetic design itself eliminates the need for a separate butt end fastening system and simplifies installation of the roofing panels on a roof deck. In FIG. 1, the region of overlap is indicated by dashed line 30 and is seen to correspond to the length of the truncation 23. In this way, the slot 21 is substantially continuous along the trailing edges of a course of roofing panels when the panels are overlapped and installed as described. The second end of a panel has the identical graphics and embossments as the first end so that two panels will overlap one another at their ends in a substantially seamless fashion.

With continued reference to FIGS. 1-3, the asphaltic aesthetic of the field consists of alternating raised and flat sections with varied dimensions that emulate the shape of traditional asphaltic shingles. The field of each panel preferably is divided into three "courses," each vertically offset from the course below by a specified distance. The plane created by that offset defines the flat sections; i.e. the base layer, of the specific course. The plane of the flat section is angled such that the trailing edge of each course is in plane with the training edges of other courses and with courses on adjacent panels and also with the bottom of the face along the leading edge of the panel. The raised sections of each course, which emulate dragon teeth, taper from an initial height to a reduced height from the leading edge of the course to the vertical wall generated by the course offset. This taper creates the impression of overlapping courses typical of asphaltic shingles.

FIGS. 4-6 show the roofing panel of this invention embodying an aesthetic that emulates the appearance of traditional cedar shakes when installed on a roof. Various elements of this embodiment are the same as corresponding elements of FIGS. 1-3 and thus need not be described again in detail. These include, for instance, the clips along the forward edges, the slots along the rear edges, and the truncated or cut-out section of the slot at one end of the panel. Accordingly, the discussion of FIGS. 4-6 will focus primarily on other features of the embodiment that are different from those of FIGS. 1-3.

Referring to FIGS. 4-6, a roofing panel 31 comprises an aesthetic field 32, a leading edge 33, a trailing edge 34, a first end 36, and a second end 37. A clip 35 extends along the leading edge of the panel and a slot 45 configured to receive the clip extends along the trailing edge 34 within a headlap section 40 of the panel. The headlap portion 40 is notched or truncated at the second end 37 to facilitate end-to-end overlapping of like panels in a shiplap fashion. The field 32 of the panel preferably is printed, coated, or otherwise provided with graphics that emulate the appearance of traditional cedar shakes. In addition, the field 32 is embossed, pressed, or otherwise formed to exhibit textures that emulate the texture of traditional cedar shakes. More specifically, as shown in FIG. 6, the embossed texture includes raised facsimiles of individual cedar shakes each having texture and grain 38 that emulates the texture and grain of cedar shakes. Depressed or flat areas 39 between the raised areas form spaces that emulate the gaps between adjacent cedar shakes on a traditional cedar shake roof. The space 44 adjacent the first end 36 of the panel forms a water barrier or water dam when the second end 37 of a like panel is overlapped with the first end 36.

In the overlapped area, the barriers to water infiltration in this embodiment also are created by the ridges and valleys within the shake section beneath the overlapped panel. The depressed flat areas 39 emulating spaces preferably are of uniform width, while the widths of the individual raised shake sections can be different from each other and unique. The top surfaces of the shake sections are formed with variegated surface geometries including valleys, ridges, and other organic features typical of hand cut cedar shakes. The virtual plane of these features tapers from the leading edge of each course of shakes to the trailing edge of the course, thus simulating the wedge shape and overlapping arrangement of traditional cedar shake shingles.

Figure 7:
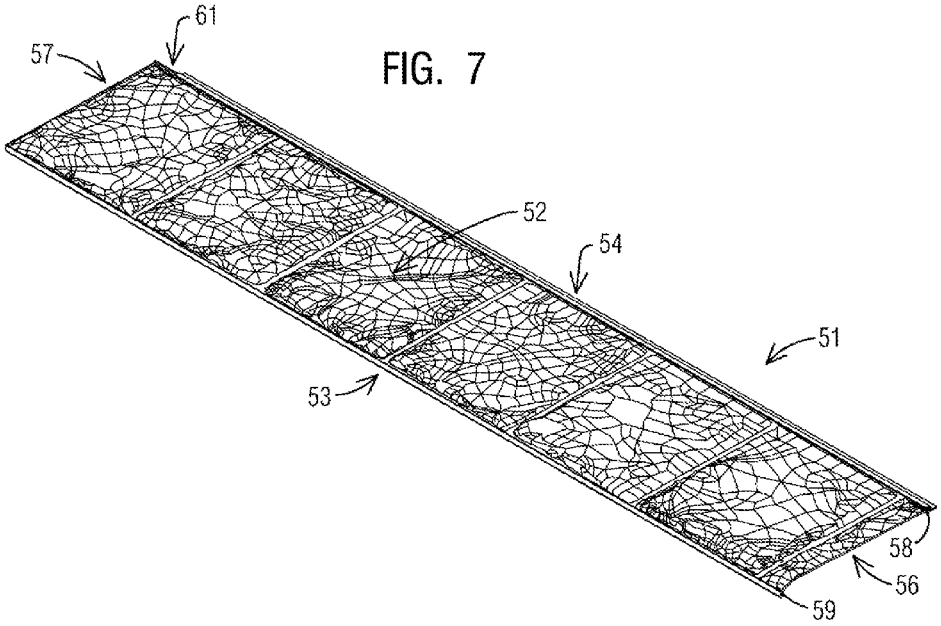
FIG. 7 is a top perspective view of a roofing panel that embodies principles of the invention in another preferred form.
Figure 8:
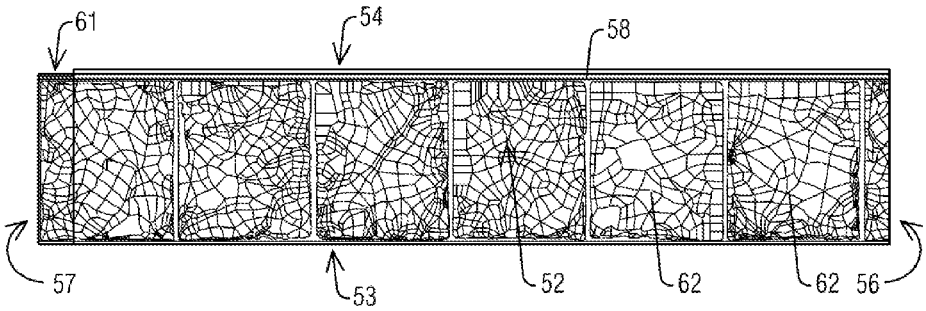
FIG. 8 is a top plan view of the roofing panel of FIG. 7.
Figure 9:
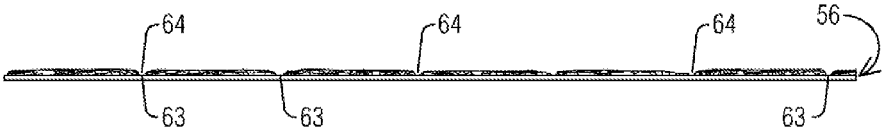
FIG. 9 is a lower edge view of the roofing panel of FIG. 7

FIGS. 7-9 illustrate an embodiment of the invention that emulates the appearance of a traditional slate roof when installed. Again, features already described in detail above will not be described in detail here. The panel 51 of this embodiment, which preferably is made of metal sheet, comprises a field 52, a leading edge 53 with a clip 59, a trailing edge 54 defining a headlap portion with a slot for receiving the clip of a next higher panel during installation, and a truncated section 61. The field in this embodiment is embossed, pressed, or otherwise formed to emulate the appearance of traditional slate shingles when a roof is tiled with the panels 61. More specifically, the filed is printed, coated, or otherwise supplied with graphics that emulate the appearance of side-by-side individual slates 62 separated by flat spaces 63. In addition, the individual slates 62 are embossed to form a surface texture that emulates the surface texture of traditional slate shingles. Preferably, the embossed features of the individual slates are aligned with the graphics to provide a more realistic aesthetic on a roof.

The second end 57 of the panel 52 is configured to overlap the first end 56 by the width of the truncated section during installation of panels on a roof. In this regard, the embossed portion at the overlapping second end 57 is identical to the embossed portion at the first end 56 that it will overlap. This ensures a better fitting and a tighter overlap that is virtually seamless on a roof. The depressed or flat space 64 adjacent the first end 56 of the panel forms a water dam to impede the infiltration of water between the panels in the shiplapped region. During installation, panels are installed end-to-end in one course and the next higher course is installed with its clips interlocked with the slots of the lower course of panels. The result is a roof that closely emulates in appearance a traditional slate tile shingled roof.

Only a single course of slate tiles is included in the panel of the embodiment of FIGS. 7-9. This is due to the typical exposure for slate roofing materials being larger than that of the asphaltic shingle or cedar shake. The water dam or barrier in the overlapping area is created by the offset between the flat space 64 and the raised surface of the adjacent slate areas. The width of the spaces between slates preferably is uniform. The embossed and coated surfaces of the slate sections are unique and include features typical of and emulating the natural geometry of traditional slate tiles.

FIGS. 10-12 illustrate yet another embodiment of the present invention in the form of a roofing panel that emulates a traditional clay barrel tiled roof when installed. In this embodiment, a panel 68 includes a field 74, a leading edge 69, a trailing edge 71, a first end 72, and a second end 73. The leading edge 69 is downturned as shown in FIG. 12 and forms along its bottom edge a clip 76 that, again, is configured to be received in interlocking relationship with a slot 77 formed along the headlap portion 75 of the panel during installation. The field 74 of this embodiment is printed, coated, or otherwise provided with graphics that emulates the appearance of traditional clay barrel tile roofing. Alternatively, or in addition, the field may be covered with granules, clay dust, or other material that emulates the look of clay barrel shingles. The field preferably is embossed, pressed, or otherwise formed to emulate the shape of traditional clay barrel tiles and the shapes may be aligned with the graphics for a more realistic result. More specifically, the field is formed to define arched raised portions 78 separated by depressed portions 79 to emulate the alternating upturned and downturned tiles of a traditional clay barrel roof.

Figure 15:
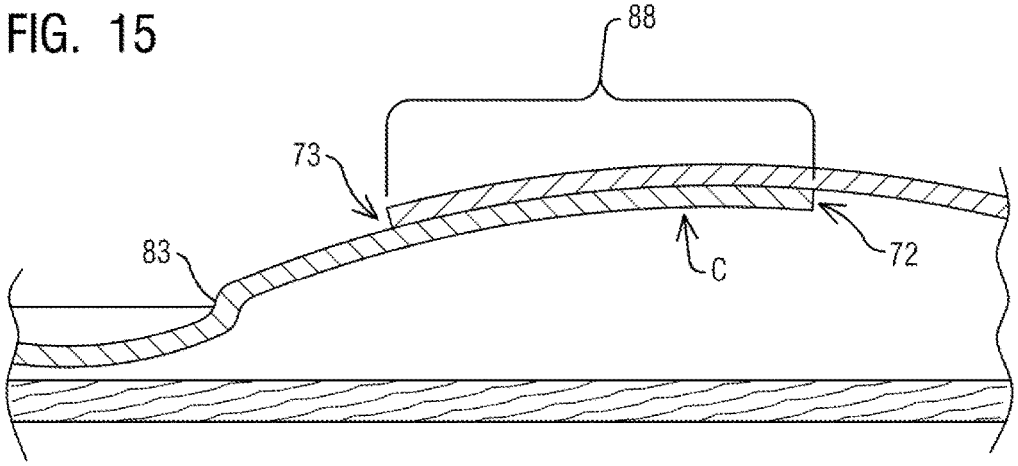
FIG. 15 illustrates the overlap of end-to-end installed roofing panels of claim 10 illustrating the overlap that helps prevent leakage at the overlapped ends of the panels.

In the overlapping area of two end-to-end panels of this embodiment, the second or overlapping end of one panel extends beyond the centerline of the barrel section of the underlying panel. This is perhaps best illustrated in FIG. 15, wherein the overlapping region within which the right panel overlaps the left panel is indicated by reference numeral 88 and the centerline of the overlapped portion of the left panel is indicated by the letter C. With this configuration, water is blocked from reaching the end of the underlying panel by the upward curve of the barrel surface, which tends to shed water down the curve away from the butt joint. Panels of this embodiment also have downturned closed leading edges 69 (FIG. 12). Among other things, this eliminates the need for an edge cap at the eve of a roof, which is common with prior art designs.

To emulate better the effect of overlapping tiles, the front face of each course of embossed barrels is larger than at the rear surface of the barrel section by the thickness of the desired barrel tile being emulated. Further, the side edges of each barrel section are tapered to ensure that the resulting visual effect is that of a full tile. Additionally, there is a vertical step on the side edges, which creates the visual effect of the edge thickness of a real barrel tile. The inter-barrel area (space between raised barrel sections) also includes geometry that lofts from a downwardly curved shape at the leading edge of the panel to a flat surface that intercepts the headlap area 75. This creates the visual effect of having an overturned clay barrel tile underneath and spanning the distance between the two adjacent raised barrel sections while maintaining the thickness expected for such a tile.

Figure 13:
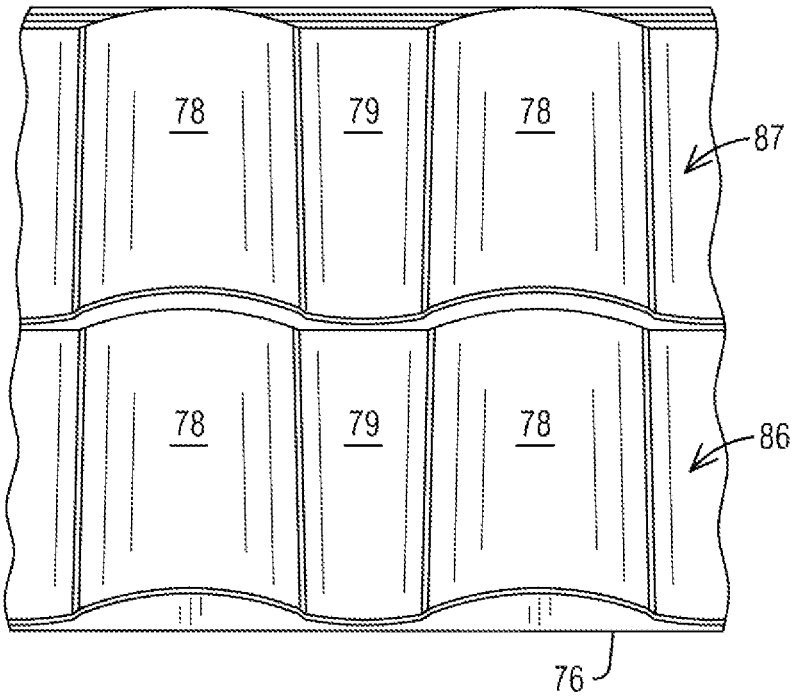
FIG. 13 is a perspective view of two courses of installed panels according to the embodiment of claim 10 showing one possible arrangement of the panels in each course.
Figure 14:
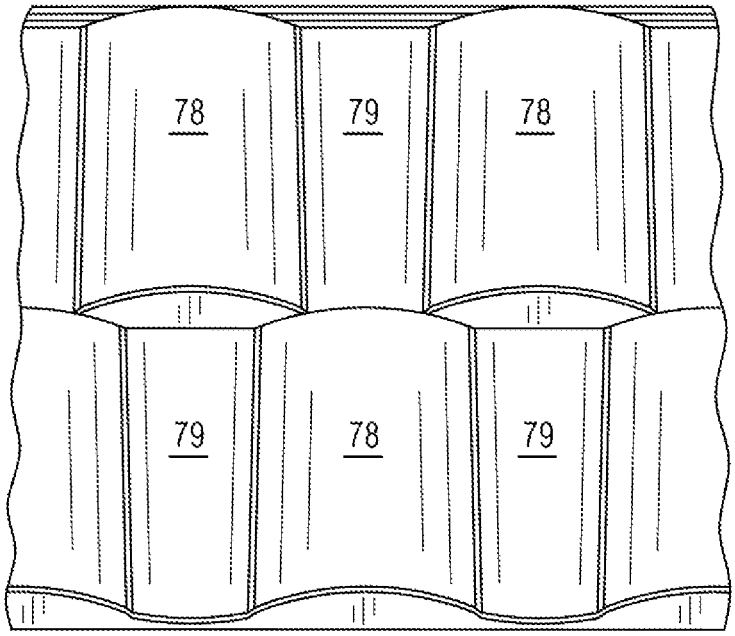
FIG. 14 is a perspective view of two courses of installed panels according to the embodiment of claim 10 showing another possible arrangement of the panels in each course.

FIG. 13 shows the barrel tile embodiment of this invention installed in a traditional pattern with the upturned barrels 78 of one course 86 aligned with the upturned barrels 78 of the next higher course 87 and the downturned tiles 79 also being aligned from course to course. The barrel tile embodiment of the present invention also can be installed in novel configurations such as that shown in FIG. 14. Here, the raised barrels 78 of a higher course are aligned with the downturned barrels 79 of the next lower course. Such a pattern, which may be thought of as a half shifted pattern, is not possible with traditional real clay barrel tiles, but nevertheless is novel and considered by some to be visually appealing. Other patterns such as quarter shifted tiles, for instance, also are possible. Such arrangements are made possible in the present invention at least in part by the closed leading and trailing edges of each panel.

Figure 16:
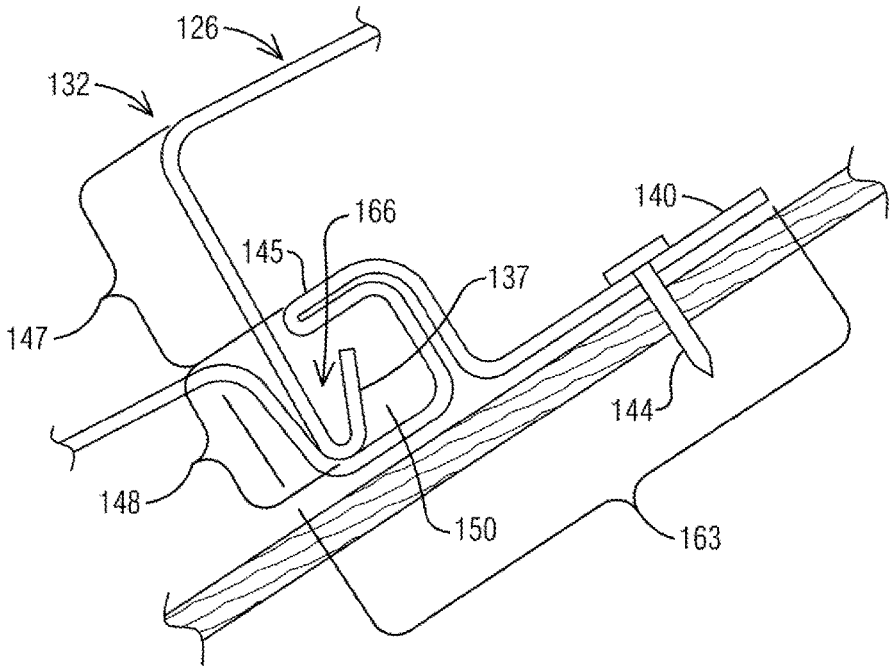
FIG. 16 illustrates the clipping system along the top and bottom edges of roofing panels of this disclosure.

FIG. 16 is a cross-sectional view showing in more detail one preferred embodiment of the interlocking clipping system of the roofing panels described above. In this figure, the leading edge 132 of a roofing panel in one course has an upper portion 147 and a lower portion 148 and is shown interlocked with the headlap portion 163 of a roofing panel in a next lower course. More specifically, the headlap portion 163 is roll formed or otherwise shaped to define a slot 150 that is upwardly open and partially bounded by an in-turned lip 145. A nailing flange 140 projects rearwardly from the slot 150 and is configured to receive nails 144 for attaching the lower course roofing panel to a roof deck. As mentioned above, the lower portion 148 of the forward edge 132 of the upper course panel is formed to define a clip 166 that includes an upturned return flange 137.

During installation, a course of roofing panels is installed with the panels of the course arranged in end-to-end overlapping relationship as described above. Each panel is attached to the roof deck with nails 144 driven through the nailing flange 140 and into the roof deck. Panels of the next higher course are positioned with their clipping features aligned with the openings of the slots 150. Their leading edges are then pressed downwardly toward the deck until the return flanges of the clipping features snap into the slots and lodge beneath the tongues 145. The clipping features thus become interlocked within the slots and the slots and clipping features form a substantially impenetrable barrier to rainwater that might otherwise seep between courses of panels. Of course, many other configurations of the clipping interlocking system may be substituted by the skilled artisan and all are intended to be within the scope of the present invention.

The invention has been described herein in terms of preferred embodiments and methodologies considered by the inventors to represent the best modes of carrying out the invention. Clearly, however, many additions, deletions, and modifications, both subtle and gross, might well be made to the illustrated embodiments by skilled artisans without departing from the spirit and scope of the invention embodied therein. For example, while pressed and/or embossed metal panels have been described, the panels also could be vacuum molded from sheets of PVC or other polymeric material. The specific designs of the aesthetic fields presented above are not limiting and many other architectural designs may also be eliminated, including other traditional shingle designs and new designs not previously used on roofs. Thus, the scope of the invention is not limited by the exemplary embodiments described herein but is circumscribed only by the claims hereof.

What is claimed is:

1. A roofing panel comprising an upwardly facing side, a downwardly facing side, a field having ends, an upper edge, a lower edge, a first end, and a second end;

the field of the roofing panel being ornamented to emulate the appearance of a roofing shingle;

the ornamented field extending from the first end of the roofing panel to the second end of the roofing panel with no part of the roofing panel projecting beyond the ends of the field;

a clip extending along the lower edge of the roofing panel projecting downwardly therefrom;

a slot extending along the rear edge of the roofing panel having an upwardly facing elongated opening;

the slot being cut short to define a truncated region at the first end of the roofing panel such that the second end of a like panel can be overlapped onto the first end in such a way that the ornamentation on the field of the roofing panel at least partially overlaps the ornamentation on the field of the like roofing panel;

the ornamentation on the field of the like roofing panel being configured to prevent water migration through the region of overlap of the roofing panel and the like roofing panel.

2. A roofing panel as claimed in claim 1 wherein the field of the roofing panel is coated to resemble a roofing shingle.

3. A roofing panel as claimed in claim 2 wherein the field of the roofing panel is embossed to resemble a roofing shingle.

4. A roofing panel as claimed in claim 3 wherein the embossing is registered with the coating.

5. A roofing panel as claimed in claim 1 wherein the clip is configured to be pressed through the opening of the slot and lock within the slot.

6. A roofing panel as claimed in claim 1 further comprising a nailing flange projecting rearwardly from the slot for receiving attaching nails in such a way that the nails are covered by a next higher course of roofing panels when the panels are installed on a roof.

7. A roofing panel as claimed in claim 3 wherein the embossing is registered with the coating.

8. A roofing panel as claimed in claim 1 wherein the field of the roofing panel is covered with a material secured to the roofing panel with adhesive.

9. A roofing panel as claimed in claim 8 wherein the material comprises granules.

10. A roofing panel comprising a front side facing a front direction, a back side facing a back direction, a substantially rectangular field, an upper edge, a lower edge, a first end having a terminal edge, and a second end having a terminal edge;

the field of the roofing panel being ornamented to emulate the appearance of a roofing shingle and extending from the terminal edge of the first end of the roofing panel to the terminal edge of the second end of the roofing panel;

a clip extending along the forward edge of the roofing panel projecting in the back direction therefrom, the clip having an upturned distal edge;

a slot extending along the upper edge of the roofing panel formed by an elongated opening facing in the front direction, the slot being partially closed by an in-turned lip;

the slot being cut short to define a truncated region at the first end of the roofing panel such that the second end of a like panel can be overlapped onto the first end in such a way that an upwardly facing slot is defined substantially continuously along the rear edges of the overlapped panels;

part of the ornamentation on the second end of the like roofing panel overlapping part of the ornamentation on the first end of the roofing panel when the panels are arranged end-to-end;

the ornamentation on the first end of the roofing panel including features that form barriers against water migration through the region of overlap of the roofing panel and the like roofing panel.

11. A roofing panel as claimed in claim 10 wherein the slot is sized to receive the downwardly projecting clip of a panel in a next higher course of panels in interlocking engagement.

12. A roofing panel as claimed in claim 11 wherein the upturned distal edge of the clip snaps beneath the in-turned lip of the slot to lock the lower edge of one panel into the slot along the upper edge of a panel in a next lower course of panels.

13. A roofing panel as claimed in claim 10 wherein the field is embossed.

14. A roofing panel as claimed in claim 10 wherein the field is printed or painted.

15. A roofing panel as claimed in claim 10 wherein the field is textured.

16. A roofing panel as claimed in claim 10 wherein the field is at least partially covered with material adhered to the panel.

17. A roofing panel as claimed in claim 10 wherein the field is ornamented to emulate a roofing shingle selected from the group consisting essentially of asphalt shingles, cedar shakes, slate shingles, and clay barrel shingles.

18. A rectangular metal roofing panel comprising an upwardly facing side, a downwardly facing side, a substantially rectangular field, a leading edge, a trailing edge, a first end, and a second end, a downwardly turned clip extending at least partially along the leading edge of the roofing panel and having an upturned distal edge, and an upwardly open slot extending at least partially along the trailing edge of the roofing panel, the slot being partially occulted by an in-turned flange, the downturned clip and the slot being configured to interlock together with the upturned distal edge of the downturned clip becoming trapped below the in-turned flange when the leading edge of one panel is pressed downwardly onto the trailing edge of a like panel to lock the panels together and form a moisture barrier, the substantially rectangular field extending from a terminal edge of the first end of the panel to a terminal edge of the second end of the panel and being pressed or embossed with features that resemble shingles and wherein at least one of the features forms a water dam adjacent the first end of the panel to prevent water migration beneath the second end of a like panel overlapping the at least one of the features on the first end of the panel.

19. A metal roofing panel as claimed in claim 18 wherein the slot is cut short to define a truncated region at the first end of the panel to accommodate the overlapping of the first end by the second end of a like panel arranged in end-to-end relationship so that a substantially continuous slot is formed along the trailing edges of the end-to-end panels.

20. A roofing panel comprising an upwardly facing side, a downwardly facing side, a field, an upper edge, a lower edge, a first end having a terminal edge, a second end having a terminal edge, a clip, and a slot;

the field of the roofing panel comprising one or more ornamental features that extend from the terminal edge of the first end of the roofing panel to the terminal edge of the second end of the roofing panel;

the clip extending along the lower edge of the roofing panel;

the slot extending along the rear edge of the roofing panel, the slot being cut short to define a truncated region at the first end of the roofing panel;

the first end of the roofing panel being overlappable onto the second end of a like roofing panel in such a way that the one or more ornamental features of the field of the roofing panel at least partially overlaps the one or more ornamental features of the field of a like roofing panel and the overlapped ornamental features on the like roofing panel prevent water migration through the region of overlap.

21. The roofing panel of claim 20 wherein the ornamental features comprise embossed raised areas mimicking slates separated by depressed areas mimicking gaps between slates.

22. The roofing panel of claim 20 wherein the one or more ornamental features comprise one or more depressed regions and one or more raised regions separated by the one or more depressed regions, and wherein the first end comprises a raised region and the second end comprises a raised region.

23. The roofing panel of claim 22 wherein the raised regions comprise at least a first arched region at the first end and a second arched region at the second end.

* * * * *